US010550672B2

(12) United States Patent
Falk et al.

(10) Patent No.: US 10,550,672 B2
(45) Date of Patent: Feb. 4, 2020

(54) WELL PRODUCTION SYSTEM

(71) Applicant: Source Rock Energy Partners, Inc., Calgary (CA)

(72) Inventors: Kelvin Falk, Calgary (CA); Brandon Yorgason, Rockyford (CA)

(73) Assignee: Source Rock Energy Partners Inc., Calgary (CA)

( * ) Notice: Subject to any disclaimer, the term of this patent is extended or adjusted under 35 U.S.C. 154(b) by 320 days.

(21) Appl. No.: 15/217,369

(22) Filed: Jul. 22, 2016

(65) Prior Publication Data

US 2017/0022791 A1 Jan. 26, 2017

Related U.S. Application Data

(60) Provisional application No. 62/196,536, filed on Jul. 24, 2015.

(51) Int. Cl.

| | |
|---|---|
| ***E21B 43/12*** | (2006.01) |
| ***E21B 37/00*** | (2006.01) |
| ***E21B 47/06*** | (2012.01) |
| ***E21B 43/14*** | (2006.01) |
| ***E21B 34/06*** | (2006.01) |
| *E21B 47/00* | (2012.01) |

(52) U.S. Cl.

CPC ..... *E21B 43/121* (2013.01); *E21B 34/06* (2013.01); *E21B 37/00* (2013.01); *E21B 43/124* (2013.01); *E21B 43/14* (2013.01); *E21B 47/065* (2013.01); *E21B 47/0007* (2013.01)

(58) Field of Classification Search

CPC ..... E21B 43/121; E21B 43/124; E21B 43/14; E21B 47/06; E21B 47/065; E21B 47/0007; E21B 37/00; E21B 34/06

See application file for complete search history.

(56) References Cited

U.S. PATENT DOCUMENTS

| | | | | |
|---|---|---|---|---|
| 6,250,389 | B1 * | 6/2001 | Sudol | E21B 37/00 166/222 |
| 2013/0084194 | A1 * | 4/2013 | Falk | F04F 5/48 417/53 |
| 2017/0226830 | A1 | 8/2017 | Simpson | |

* cited by examiner

*Primary Examiner* — Yong-Suk Ro

(74) *Attorney, Agent, or Firm* — Bookoff McAndrews, PLLC

(57) ABSTRACT

A pumping system and a method operative to utilize at least two downhole pump assemblies to produce hydrocarbons from at least two locations of a subterranean reservoir, wherein the pump assemblies are controllably adjusted to synergistically provide uniform draw down from the wellbore.

22 Claims, 7 Drawing Sheets

WELL PRODUCTION SYSTEM

CROSS-REFERENCE TO RELATED APPLICATIONS

This application claims the benefit of priority to U.S. Provisional Application No. 62/196,536, filed Jul. 24, 2015, the entirety of which is incorporated herein by reference.

FIELD OF THE DISCLOSURE

Embodiments herein relate to a system and a method for producing fluids from a subterranean well. More specifically, a pumping system and a method are provided for producing fluid from at least two downhole locations along the lateral section of horizontal wells.

BACKGROUND

Various downhole well configurations, including vertical, directional, or horizontal, are used in oil and gas production from subterranean formations. With reference to FIG. 1 (PRIOR ART), horizontal wells W typically comprise a relatively vertical section V (which may be vertical or off-vertical) and a relatively lateral section L (which may or may not be horizontal) that are connected by a curved 'build' section, often referred to as the 'heel' H. In almost all cases, the lateral section is the productive target of the well and will be configured to allow the inflow of fluids (oil/water/gas) from the reservoir into the wellbore. The configuration of horizontal wells often results in a complex interaction or interference between liquids and gas within the lateral and heel sections L,H, compounded by the fact that the lateral section L will often undulate significantly along its overall trajectory.

For example, horizontal wells can have sub-hydrostatic flowing reservoir pressures that require artificial lift systems to produce the well, but conventional lift systems, such as pumps, gas lifts, or plunger lifts are not suited for installation deeper than the H section of the well (i.e. into the L section of the well). Due to the size constraints, artificial lift systems can often only be positioned in the wellbore near or above the heel section H (FIG. 1, PRIOR ART). When artificial lift systems are not positioned within the productive target area, the resulting inflow of fluids becomes inconsistent, with the majority of the produced fluids coming from near the heel section H and less coming from the target lateral section L.

Problems arise when the positioning of a pump P creates higher inflow drawdown from the areas of the reservoir closest to the heel H of the well (e.g. drainage area "A" in FIG. 1) and less inflow drawdown towards the toe T of the well. Even where smaller pumps, such as jet pumps, have been extended to be near the mid-point of the lateral section L, substantial flow interference arises because as production progresses over time, gas G flowing upwardly towards the vertical V section travels against the liquids O flowing downwardly towards the pump P intake (FIG. 2, PRIOR ART). For instance, oil, water, and gas generally flow in the direction from the toe T section of the well to the pump P' intake location; however, in the portion of the well between the pump P location and the heel H section, gas flows in the opposite direction from the flow of liquids (i.e. oil and/or water). Flow interference arises when the gas G flow winds up sweeping a significant volume of liquid O up into the vertical V section of the well. This refluxing volume of liquid O and gas G results in an artificially high flowing bottom hole pressure, which limits the ultimate inflow rate of the well. Consequently, flow interference is undesirable because it diminishes the efficiency of the system. Further, problems arise when sand and other solids drop out of the produced fluid and build up, plugging the wellbore.

Therefore, there is a need for a well production system that overcomes the above-noted problems.

SUMMARY

According to a broad aspect there is provided a well production system for recovering hydrocarbons from a subterranean formation, the system comprising at least one first pump assembly, for recovering the hydrocarbons from a first section of a wellbore within the formation, the first pump assembly operative at a first production rate, and at least one second pump assembly, for recovering hydrocarbons from a second section of the same wellbore, the second section being downhole from the first section in the wellbore and the second pump assembly operative at a second production rate. Each of the first and second pump assembly production rates may be adjusted, independently or in combination, to provide a substantially uniform drawdown along the wellbore.

The present well production system may be utilized in a horizontal wellbore, the horizontal well having substantially vertical and lateral sections connected by an angled heel section. In one embodiment, both the first and second pump assemblies may be positioned downhole from the vertical section. In another embodiment, both the first and second pump assemblies may be positioned in the lateral section of the wellbore. In another embodiment, the second pump assembly may be positioned downhole from the first pump assembly, or at least farther than a mid-point along the lateral section.

Each of pump assemblies of the present well production system may be operative to produce hydrocarbons from the wellbore. In one embodiment, each of the pump assemblies may comprise at least one pump, such as a jet pump. The production rates of each pump may be controlled independently, or in combination. The production rates of each pump may be adjusted to minimize downhole fluid interference.

In some embodiments, each of the present pump assemblies may further comprise a data acquisition tool operative to obtain bottom hole pressure and temperature from the wellbore at or near the pump assembly.

In some embodiments, it is further contemplated that the present system and method may be used to clean sand and other solid contaminants (wellbore debris) that can plug up the wellbore during production. In one embodiment, it is contemplated that at least one pump assembly (i.e. the downhole assembly at or near the toe T) may be removed and substituted with a tubing string operative to flush contaminants plugging the wellbore, sweeping the contaminants towards the remaining at least one pump assembly. For example, the at least one second pump assembly and its associated inner tubing string can be temporarily removed from the well, leaving the outer tubing string in the well. The remaining outer tubing string serves to pump high fluid rates into the well and back to the first jet pump positioned uphole. As a result, sand and other contaminants become swept up in the high rate fluid in the lateral section of the well, towards the upper pump assembly. Concurrently, the at least one first pump assembly positioned uphole is operated at lift rate sufficiently high such that it lifts all of the high rate fluid being pumped down the lower tubing string, and the sand in the lateral are pulled into the upper jet pump and are lifted to surface.

According to a broad aspect there is provided a method of recovering hydrocarbons from a wellbore within a subterranean formation, the method comprising providing at least one first pump assembly in the wellbore for recovering the hydrocarbons from a first section of the wellbore, the first pump assembly operative at a first production rate, providing at least one second pump assembly in the wellbore for recovering the hydrocarbons from a second section of the wellbore, the second section being downhole from the first section of the wellbore, the second pump assembly operative at a second production rate, and adjusting one or both of the first and second production rates to provide a substantially uniform drawdown along the wellbore.

BRIEF DESCRIPTION OF THE DRAWINGS

The embodiments of the present disclosure will now be described by way of an example embodiment with reference to the accompanying simplified, diagrammatic, scale drawings. In the drawings.

DETAILED DESCRIPTION OF THE DISCLOSURE

According to embodiments herein, systems and methods for recovering hydrocarbons from a subterranean formation are provided, the system and methods using at least two downhole pump assemblies capable of synergistically reducing fluid interference and improving lift performance of the production system. Each pump assembly, alone or in combination, may be used to throttle downhole fluid flow, optimizing uniform draw down along the well and enhancing production. The present systems and methods may further be configured to address sand and other solid contaminant fallout from the produced fluids, thereby minimizing plugging of the wellbore and further optimizing hydrocarbon production.

When describing the present assemblies, all terms not defined herein have their common art-recognized meanings. To the extent that the following description describes a specific embodiment or a particular use, it is intended to be illustrative only. The description is intended to cover all alternatives, modifications and equivalents. The scope of the claims should not be limited by the preferred embodiments set forth in the examples, but should be given the broadest interpretation consistent with the description as a whole.

Figure 1:
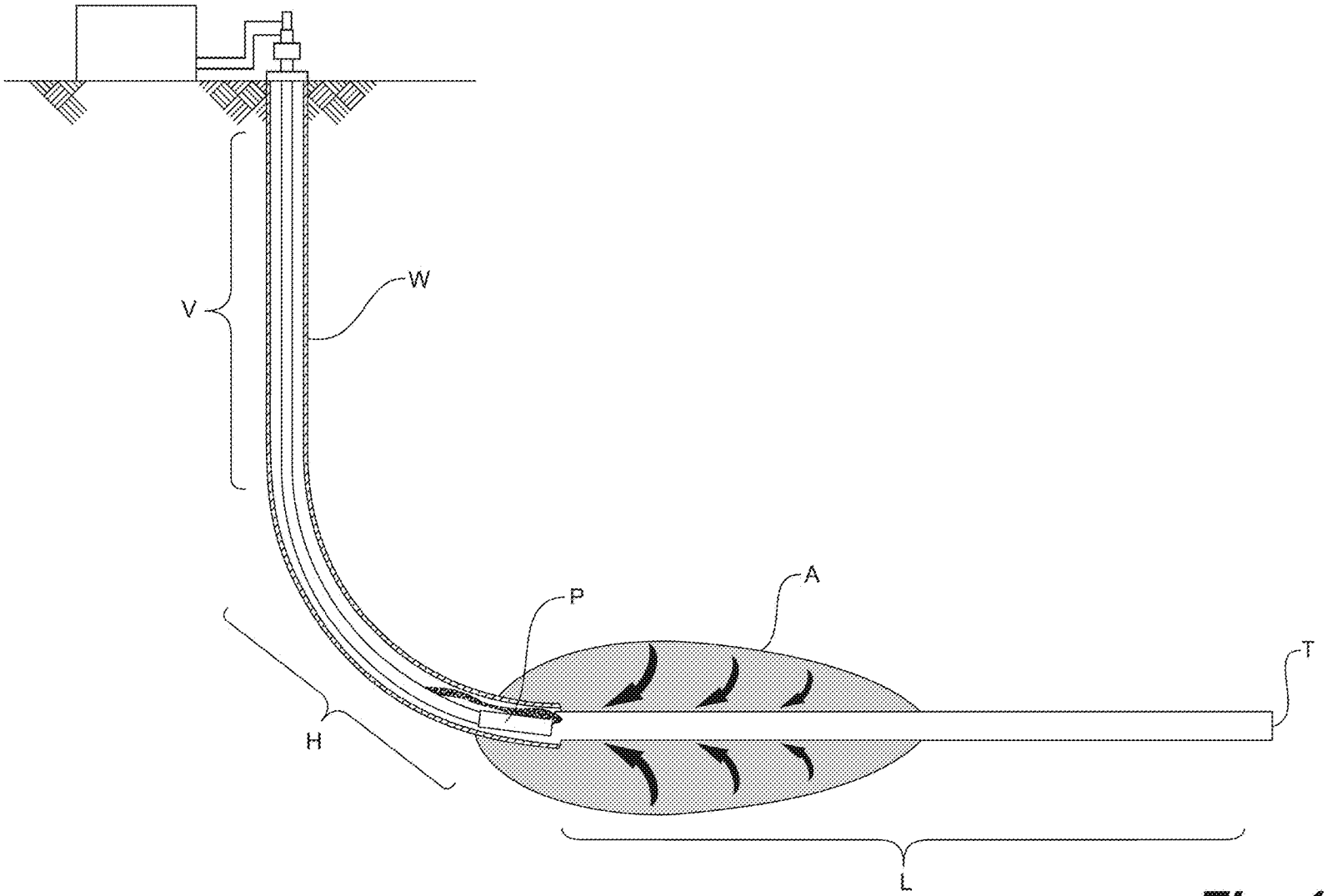
Fig. 1 PRIOR ART
FIG. 1 is a schematic drawing of a prior art well production system.
Figure 2:
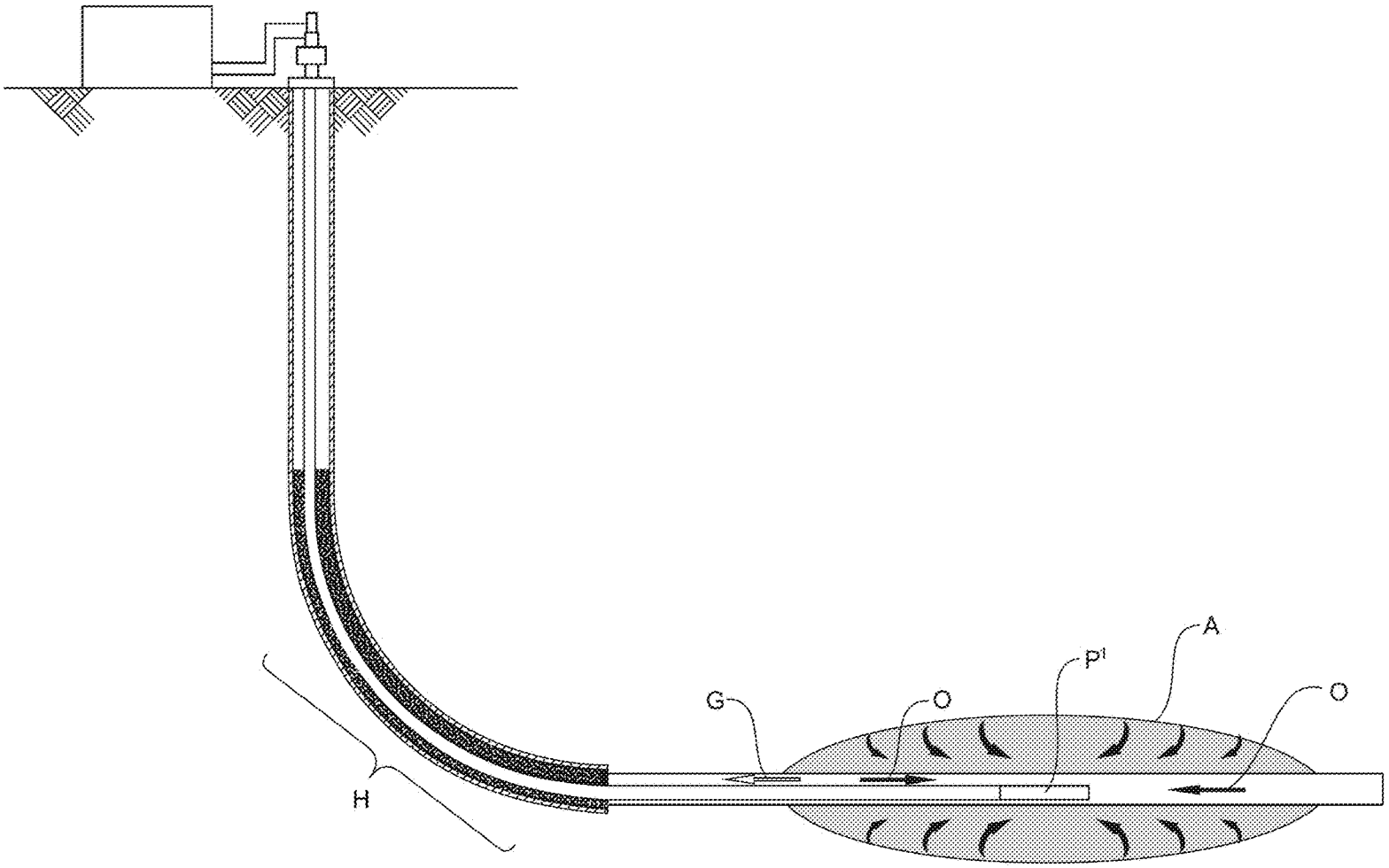
Fig. 2 PRIOR ART
FIG. 2 is a schematic drawing of another prior art well production system.
Figure 3:
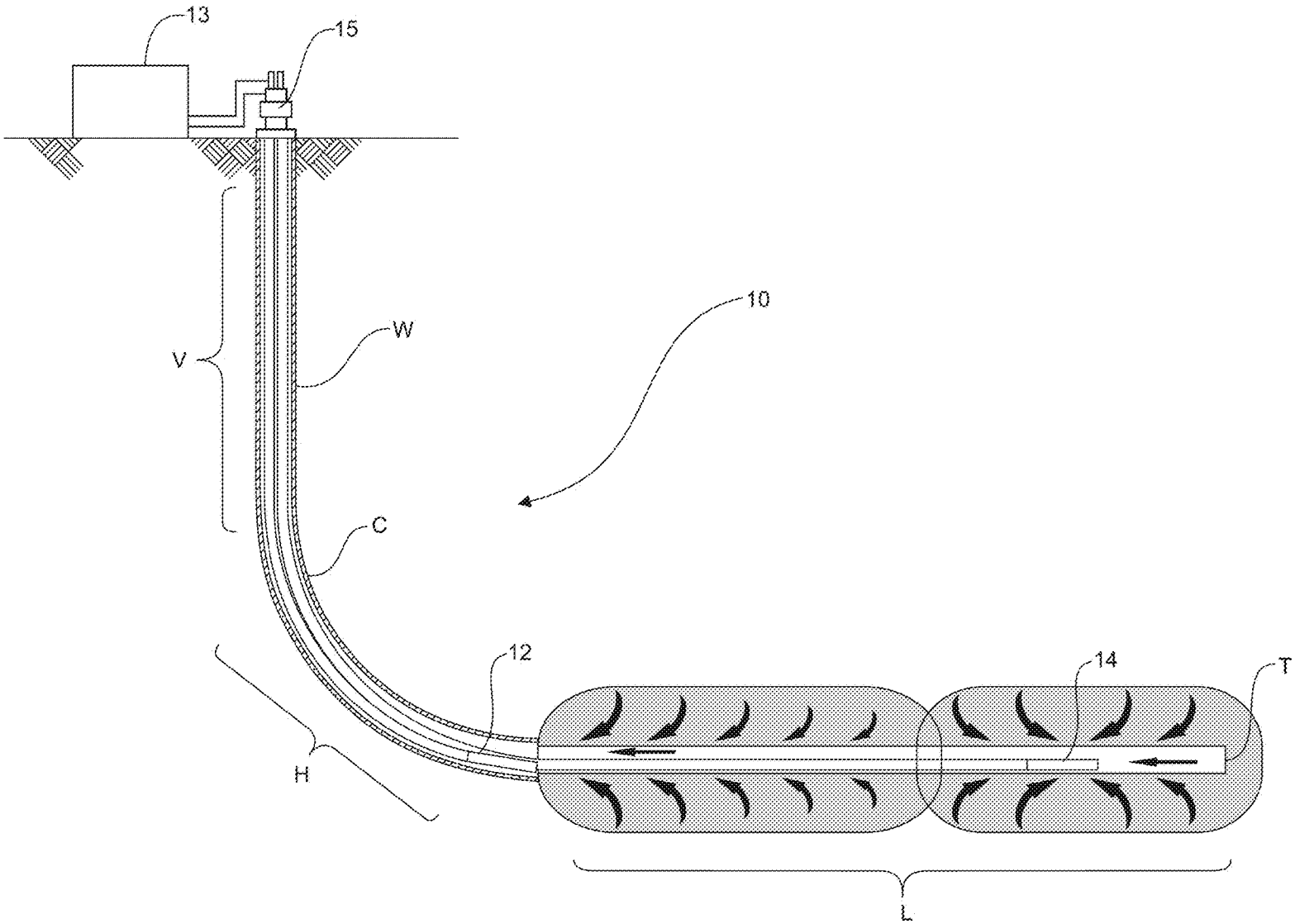
FIG. 3 is a schematic drawing of the present well production system, according to one embodiment.

Having regard to FIG. 3, a well production system 10 for recovering hydrocarbons from a subterranean reservoir or formation is provided. The present well production system 10 is described for use in a wellbore W formed in a hydrocarbon containing subterranean formation, the wellbore W having a relatively horizontal configuration consisting of a substantially vertical section V and a substantially lateral section L, connected by a 'curved' and 'angled' heel section H. The wellbore W has a proximal end at or near the surface, and a toe T at a distal end away from and opposite the proximal end. The wellbore W may have a casing C with or without a well liner, or may simply be a drilled borehole (e.g. one or more sections of the wellbore may be left as openhole uncased wellbore, with no inserted tubular assembly). The diameter of the wellbore may be consistent along its entire length, or may vary (e.g. at the casing-liner overlap zone). As would be known in the art, the wellbore W may comprise a plurality of perforations or frac ports F intermittently spaced along the lateral section L to provide fluid communication with the reservoir.

According to embodiments herein, the present well production system 10 may comprise the use of at least two pump assemblies positioned within the wellbore Win communication with a power fluid pumping unit and a fluid return system, both positioned at the surface. Each of the at least two pump assemblies may be positioned within the wellbore W in a manner to produce hydrocarbons from a drainage area at or near the pump assembly, each drainage area being distinct or in fluid communication with one another. Each of the at least two pump assemblies may be positioned such that fluid production rates of one or both pump assemblies can be adjusted to increase or decrease fluid drawdown in the drainage areas, decreasing downhole fluid interference and improving overall production. For example, one advantage of the present system is that the fluid production rates achieved by of each pump assembly may be the same or different, and may be controlled (e.g. increased or decreased) to provide a substantially uniform drawdown along the wellbore W. Preferably, at least one pump assembly may serve to efficiently produce fluids from between the heel H and the toe T of the wellbore W, or along the lateral L section of the well W between the at least two pump assemblies.

In some embodiments, both of the at least two pump assemblies may be positioned downhole from (distal to) the heel section H, such that both of the at least two pump assemblies may be positioned within the lateral section L of the wellbore, each pump assembly being spaced from one another longitudinally along the lateral section L. For example, at least one 'proximal' (heel) pump assembly may be positioned in or near the heel H of the well W, and at least one 'distal' (toe) pump assembly may be positioned between the mid-point of the lateral section L of the well W and the toe T. It should be understood that additional pump assemblies may also be used.

Figure 4A:
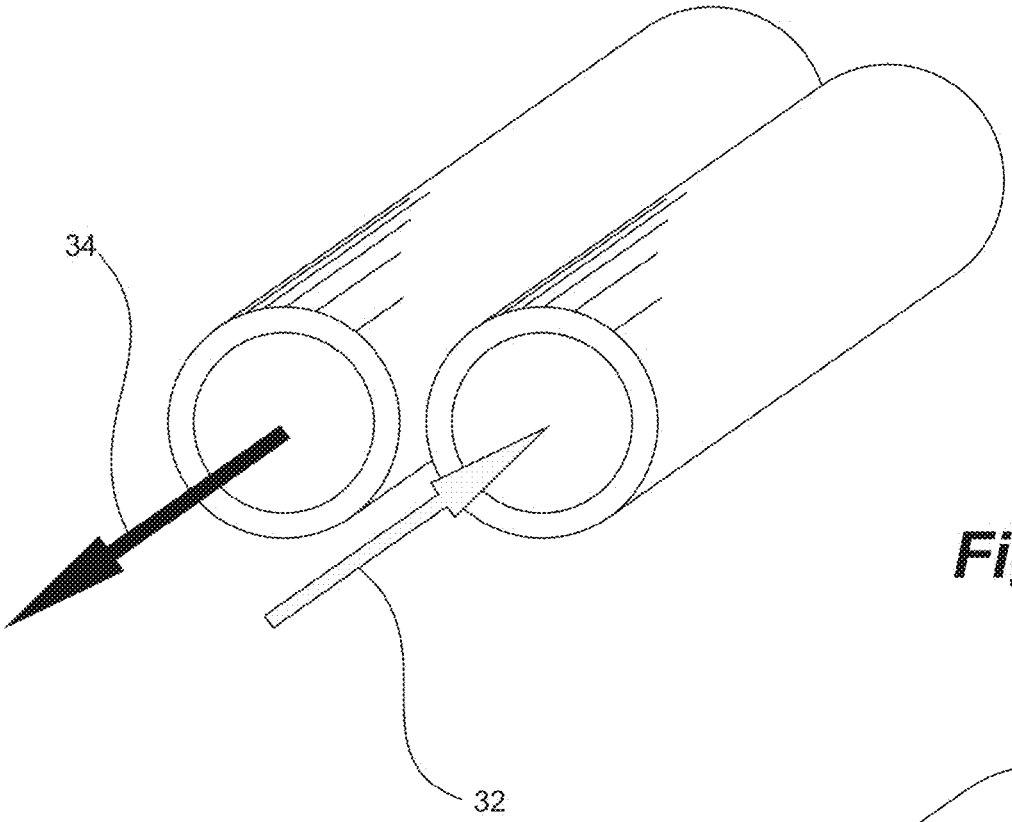
FIG. 4A is a schematic of one multi-string tubing system of the present production system having separate tubing for each of the fluid supply and return lines.
Figure 4B:
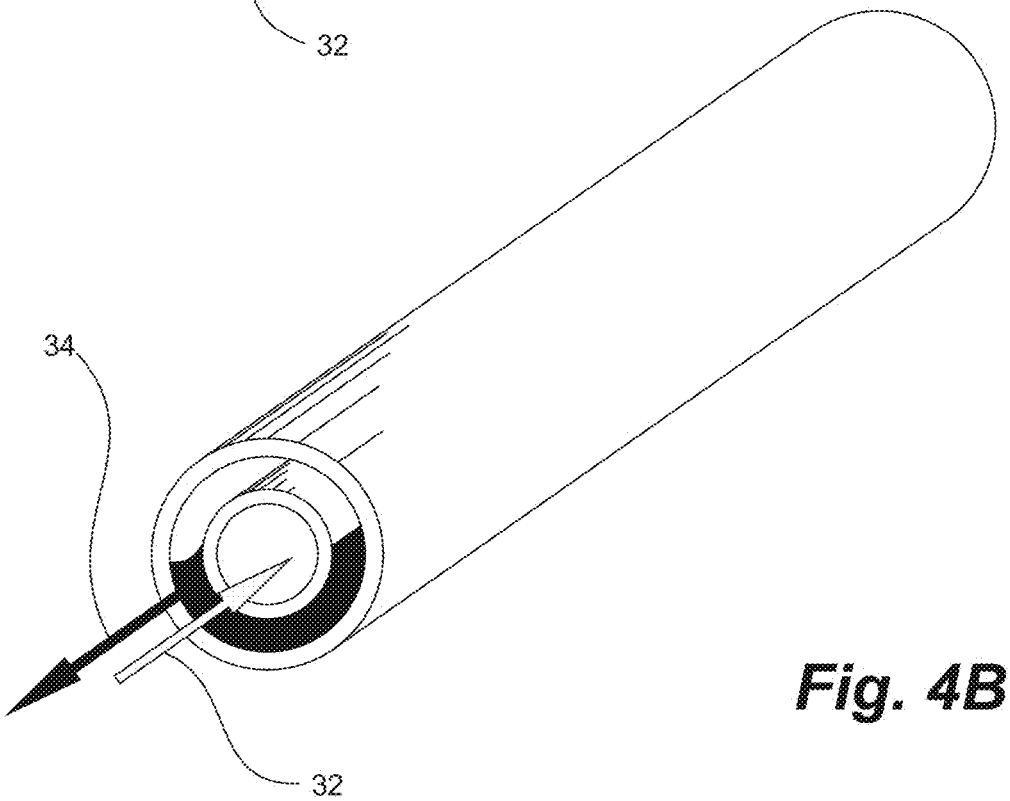
FIG. 4B is a schematic of another multi-string tubing system of the present production system having the fluid supply and return lines concentrically disposed one within the other.
Figure 5A:
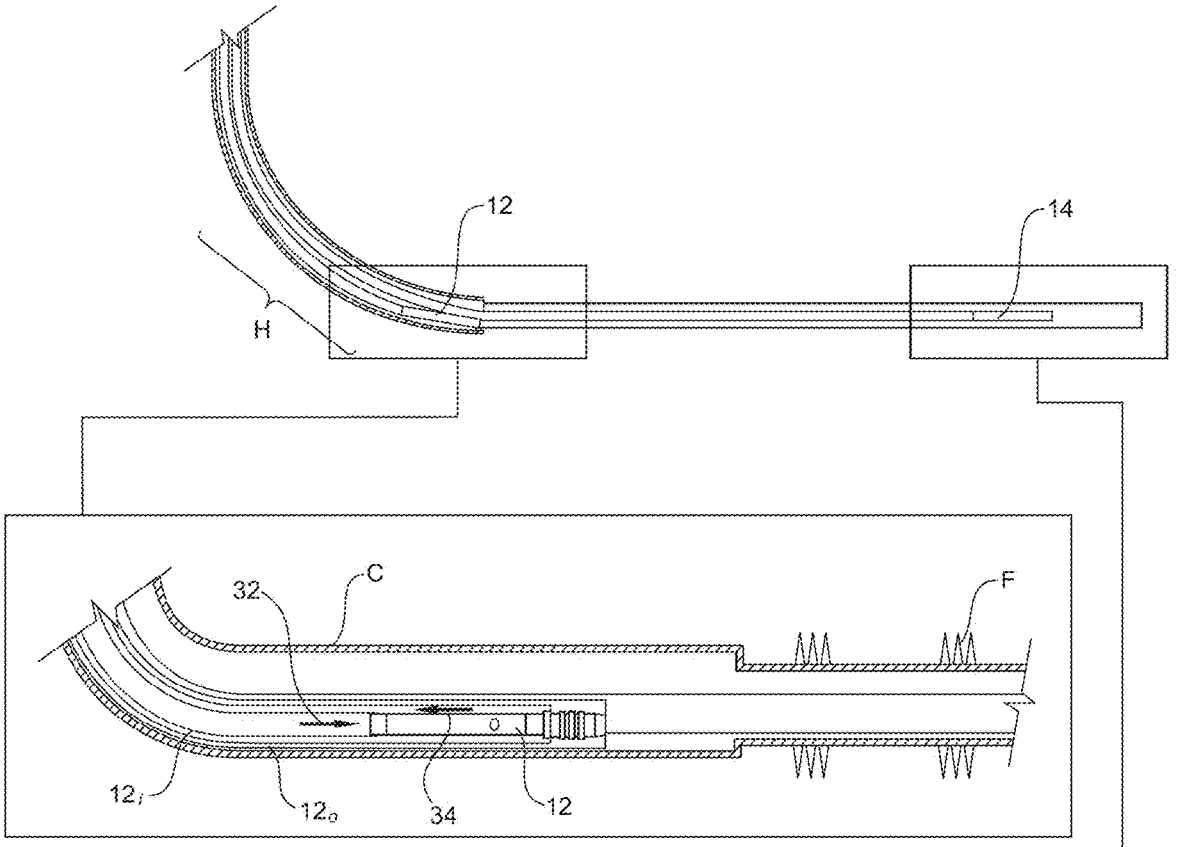
FIG. 5A is a magnified schematic drawing of the jet pump assembly at or near the heel section of the well in the well production system of FIG. 3.
Figure 5B:
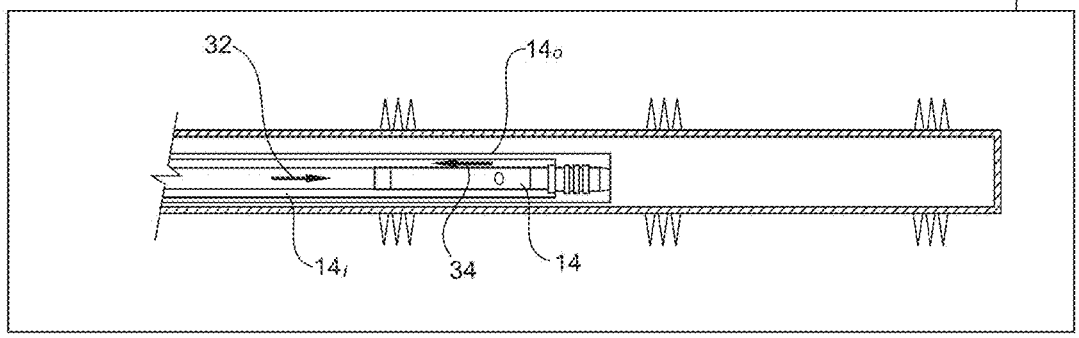
FIG. 5B is a magnified schematic drawing of the jet pump assembly at or near the toe of the well in the well production system of FIG. 3.

Without limitation, each pump assembly may be positioned in the wellbore via any downhole tubing configured to provide at least one fluid supply line (e.g. power fluid injection line) and at least one distinct fluid return line (e.g. returning produced fluids to the surface). For example, in one embodiment, a fluid injection line and a fluid return line may be run downhole using a single supply tubing string concentrically disposed within a single return tubing string, such that each pump assembly may be spaced along the dual-tubing string running downhole. In such a case, it is contemplated that the system would comprise a single injection line and a single return line for the entire wellbore, the tubing strings having the at least two pump assemblies installed along the strings such that they land spaced out along the lateral length of the wellbore (FIG. 4B). In another embodiment, the supply tubing string and return tubing string may be laterally disposed one from the other (FIG. 4A). In yet another embodiment, each at least one pump assembly may be positioned downhole using individual dual-tubing string, such that each pump assembly comprises a distinct fluid supply line and a fluid injection line in fluid communication therewith (FIGS. 5A,5B). No matter the configuration, it is understood that fluid production rates from each pump assembly may be measured, recorded, and analyzed independently from one another. As such, it is one advantage of the present system and method that at least one first pump assembly positioned at a first section of the wellbore may recover wellbore fluids from a first drainage area at a first fluid production rate, while a second pump assembly positioned in a second section of the wellbore may recover wellbore fluids from a second drainage area at a second production rate, each first and second production rates being measured and analyzed independently from one another. It is understood that one advantage of the present system and method is that one or both first and second production rates may be controlled (e.g. increased or decreased) to provide reduce or minimize downhole fluid interference, providing a substantially uniform drawdown along the well W and particularly along the lateral L or deviated sections of the well W.

Having regard to FIG. 5A, the first pump assembly comprises a first pump 12 positioned in, near, or proximal to the heel H of the wellbore W. Without limitation, and by way of illustration, if the lateral section L could be approximately divided into two halves, with the mid-way point being considered as about 50% of the length of the lateral section L, it is contemplated that the first pump 12 may be positioned past the curved portion of the heel H, and as far as 10% of the distance along the lateral L section of the well. In some embodiments, the first pump 12 may be positioned at some approximate point between 10-50% of the distance along the lateral L section (e.g. approximately between the H and half-way or near the mid-point of the lateral L section). In some embodiments, the first pump 12 may be positioned at some approximate point between 40-50% of the distance along the lateral L section. In some embodiments, and where applicable, the first pump 12 may be positioned at, or as close as possible to, the casing-well liner overlap zone or changeover.

Having regard to FIG. 5B, the second pump assembly comprises a second pump 14 positioned at or near the distal end of the lateral section, or near the toe T. Without limitation, and by way of illustration, if the lateral section L could be approximately divided into two halves, with the mid-way point considered as about 50% of the length of the lateral section L, it is contemplated that the second pump 14 may be positioned farther downhole along the lateral L section than the first pump 12. In some embodiments, the second pump 14 may be positioned somewhere between the mid-point of the lateral section L and the toe T, or at least more than 50% of the distance along the lateral L section of the well. In some embodiments, the second pump 14 may be positioned at some approximate point between 51%-90% of the distance along the lateral L section. In some embodiments, the second pump 14 may be positioned at some approximate point between 60%-80%, or approximately 75% of the distance along the lateral L section. It is desirable that the second pump 14 be distanced from the toe T (i.e. not at 100% of the lateral section L). In some embodiments, where desired, it is contemplated that the second pump 14 may be positioned at some point between 25% and 50% of the distance along the lateral section L, provided that the second pump 14 remains positioned downhole from the first pump 12. It should be understood that positioning of the at least two pump assemblies may be such that uphole pump assemblies draw fluids between said pump assembly and other pump assemblies positioned downhole. As such, uphole pump assemblies serve to minimize downhole fluid interference, or the interference caused when gas G flowing uphole travels against liquids O being drawn to the downhole pump. Instead, just gas G and liquid O will both be drawn to the uphole pump intake, improving the ultimate inflow rate of the well W.

As would be known, each pump assembly may be operatively connected to the fluid pumping system at the surface through a fluid supply tubing string, and to the fluid return system for receiving production fluids from the pump assembly through a return tubing string. For example, in one embodiment, pumps 12,14 may be in communication with the surface (via piping manifold 15) via inner tubing 12*i*,14*i* and outer tubing 12*o*,14*o*. As above, according to embodiments herein, inner tubing 12*i*,14*i*, connected to the fluid supply system, may be enclosed in the outer tubing 12*o*,14*o*, but fluidly sealed therefrom, preventing power fluid flowing to the pump 12,14 from mixing with produced wellbore fluid. Having regard to FIG. 6, pumps 12,14 may be secured to outer tubing 12*o*,14*o* by a seal assembly 16 (e.g. packoff seal), such that a return fluid annulus 18 is defined between the outer surface of inner tubing 12*i* and the inner surface of the outer tubing 12*o*.

Generally, pumps 12,14 may comprise any pump operative to produce wellbore fluids from the wellbore. According to embodiments herein, the pumps 12,14 may be any pumps having adjustable production rates (e.g., individual pump rates may be controllably increased or decreased), such as the jet pump described in Applicant's co-pending published US2013/0084194, the entire disclosure of which is hereby incorporated by reference. By way of example, pump production rates may be adjusted by adjusting power fluid rates, adjusting the pump's internal componentry, or a combination thereof.

Figure 6:
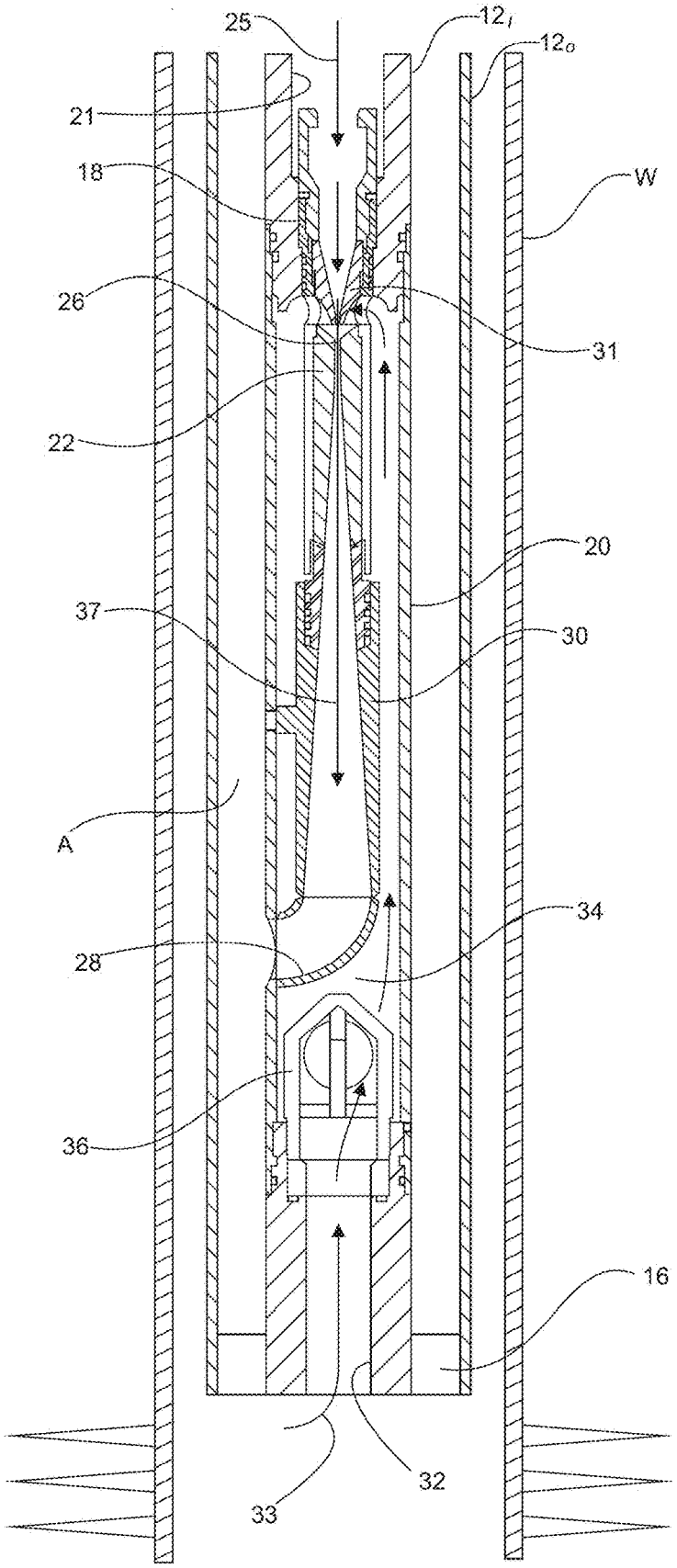
FIG. 6 is a cross-sectional view of a prior art jet pump.

Having regard to FIG. 6, pumps 12,14 may comprise a pump body 20 having an uphole end and a downhole end. The uphole end of the pump body 20 is fluidly connected to the supply tubing string such that power fluid 25 (arrow) may flow into the pump body 20 via fluid inlet 21. As would be known, the rate of power fluid 25 may be adjusted to control the pump production rates. The pump body 20 further comprises a carrier seat 18 adjacent the uphole end, in fluid communication with fluid inlet 21, fluidly connecting between the inner tubing string 12*i*, the carrier seat 18 and to a throat 22 supported below the seat 18. The throat 22 has a narrow inlet 26 and a widened outlet 28, which is fluidly connecting between the diffuser 30 and an annulus A formed between the inner and outer tubing 12*i*,12*o*. A venturi 31 is releasably supported within the carrier seat 18, forming a gap between the carrier seat 18 and the throat 22.

A production fluid intake 32, proximate the downhole end, receives production fluid 33 (arrow) entering the wellbore W through perforations therein and directs the production fluid 33 to an axially extending production conduit 34 within the pump body 20. The production fluid conduit 34 is fluidly connected between the intake 32 and the carrier seat 18 and the throat 22. A one-way valve 36, typically a standing valve, is positioned in the production conduit 34 adjacent the intake 32 for permitting production fluid 33 to enter the production conduit 34 and blocking flow therefrom to below the one-way valve 36.

In operation, power fluid 25 flows from the inner tubing string 12*i* into the venturi 31 via the power fluid inlet 21. The power fluid 25 flows past the carrier seat 18 (via ports therein) and the gap formed between the carrier seat 18 and the throat 22, creating a lower pressure thereat. The lower pressure condition forms a suction at the carrier seat 18 which induces production fluid 33 to flow into the intake 32, through the one-way valve 36, the production conduit 34 and the carrier seat 18 into the throat 22. The production fluid 33 combines with the power fluid 25 in the throat 22, which acts as a mixing tube to form a return fluid 37. As the return fluid 37 reaches the wider end of the throat 22 and the diffuser 30, the increased cross-sectional area therein, relative to the venturi 31 and the narrow inlet 26 of the throat 22, acts to increase the pressure, providing impetus for lifting the return fluid 37 to surface in the annulus A. As one of skill in the art would appreciate having reference to FIG. 6, substituting or altering the geometry of the venturi 31 and/or the throat 22 (e.g. for larger or smaller components) would necessarily result in a corresponding increase or decrease the performance parameters of the pump. It is an advantage that said components may further be substituted or replaced to replace worn out parts, without having to pull the pump 12,14 from the wellbore W, as described in US 2013/0084194. As such, adjusting power fluid 25 rates, and/or pump componentry as described, alone or in combination, may serve to independently throttle the at least two pump assemblies.

Each pump assembly may be further operative to receive and record downhole information from the wellbore W, such as described in US 2013/0084194, from each pump assembly location. In one embodiment, at least one pump assembly may comprise a data-acquisition tool or data-sensing sub, connected via a communications line (not shown) such as a small tubing string or an electrical conductor having, for example, hydraulic, electric, or fiber optic communication means. The communications line may serve to connect the data-sensing sub to the pump assembly, such that each pump assembly equipped with a data-sensing sub may be capable of retrieving, for example, downhole information about produced wellbore fluids, bottom hole pressure, temperature, or both, etc. It should be understood that that the data tool may obtain the desired information without being impacted by unwanted interference from conditions outside the data tool (e.g. pressure and temperature changes resulting from flow of power fluid in the tubing and through the venturi nozzle) and, as such, the bottom hole information retrieved from each pump assembly may be recorded and analysed to understand the overall efficacy of the present system. The information measured and retrieved from the data tool may be used to more accurately reflect wellbore drawdown conditions, enabling more efficient adjustment of at least two pumps assembly production rates. It should be understood, however, that although the data tool information is useful, it is not required for the present methodologies. By way of example, an operator may adjust one or both pump assembly production rates, increasing or decreasing production from one or more drainage areas along the wellbore, to enhance production from each end of the well (e.g. increased production from both the toe T and the heel H) using the production rates themselves, or based upon the production rates in combination with information obtained from the data tool. Without being limited to theory, the present system and methods may provide mechanisms for reducing downhole fluid interference created by conventional artificial lift systems by controlling the fluid production from at least two pumping assemblies positioned within the wellbore. Preferably, the present system and methods may provide mechanisms for achieving uniform drawdown along the lateral L or deviated sections of a horizontal wellbore W.

As would be known, the present data tool may include memory for storing data, a processor for causing the data to be stored on the memory, and a power source for providing power to the processor. The data tool may or may not be a real-time data sensing tool for providing data to the surface in real time through the communications line. The data tool may or may not receive data when the pump 12,14 is not being operated to produce return fluid 37.

The information may be retrieved from each pump assembly at the surface electronically or through pressure communication for analysis, processing, and storage. Downhole information from at least one pump assembly may be used to modify or adjust pump rates of one or more pump assemblies in order to more achieve uniform draw down from the well and to optimize production therefrom.

According to embodiments herein, a method for recovering hydrocarbons from a wellbore, such as a horizontal wellbore, is provided. The present method comprises providing at least one first pump assembly in the wellbore for recovering the hydrocarbons from a first section of the wellbore at a first production rate, and at least one second pump assembly in the same wellbore for recovering hydrocarbons from a second section of the wellbore at a second production rate. The first and second production rates may be independently controlled (e.g. throttled) to provide a substantially uniform drawdown along the well.

The present method may comprise adjusting the first and second production rates based upon samples of fluids produced from the each first and second pump assembly. By interpreting the fluid rate and fluid mixture ratios, water content of production efficiencies at each pump can be determined (e.g. whether the water content in the returned fluid is higher from one of the pump assemblies), and accounted for by adjusting (prorating) combined pump assembly injection rates and pressures accordingly, minimizing the amount of overall water produced. Pump assembly injection rates and pressures may further be adjusted by substituting internal pump components (e.g. venturi, diffuser). The present method may further comprise collecting the downhole information, such as bottom hole pressure and/or temperature data, and further adjusting the injection rates and pressures accordingly.

By way of example, it may be determined that it is desired to draw more fluid from one end of the well W. In such a case, the injection rate(s) at one or more of the pump assemblies may be altered. Alternatively or in addition, one or more pump assemblies may be reconfigured by changing out the venturi nozzle and/or throat and diffuser, increasing or decreasing the size thereof. As such, if the heel H is determined to have a high water cut, an operator may decide to increase drawdown at the toe T, which can be achieved by increasing the injection rate of the at least one second pump 14 and/or modify the nozzle and/or throat sizes in one or both of the pumps 12,14.

Figure 7:
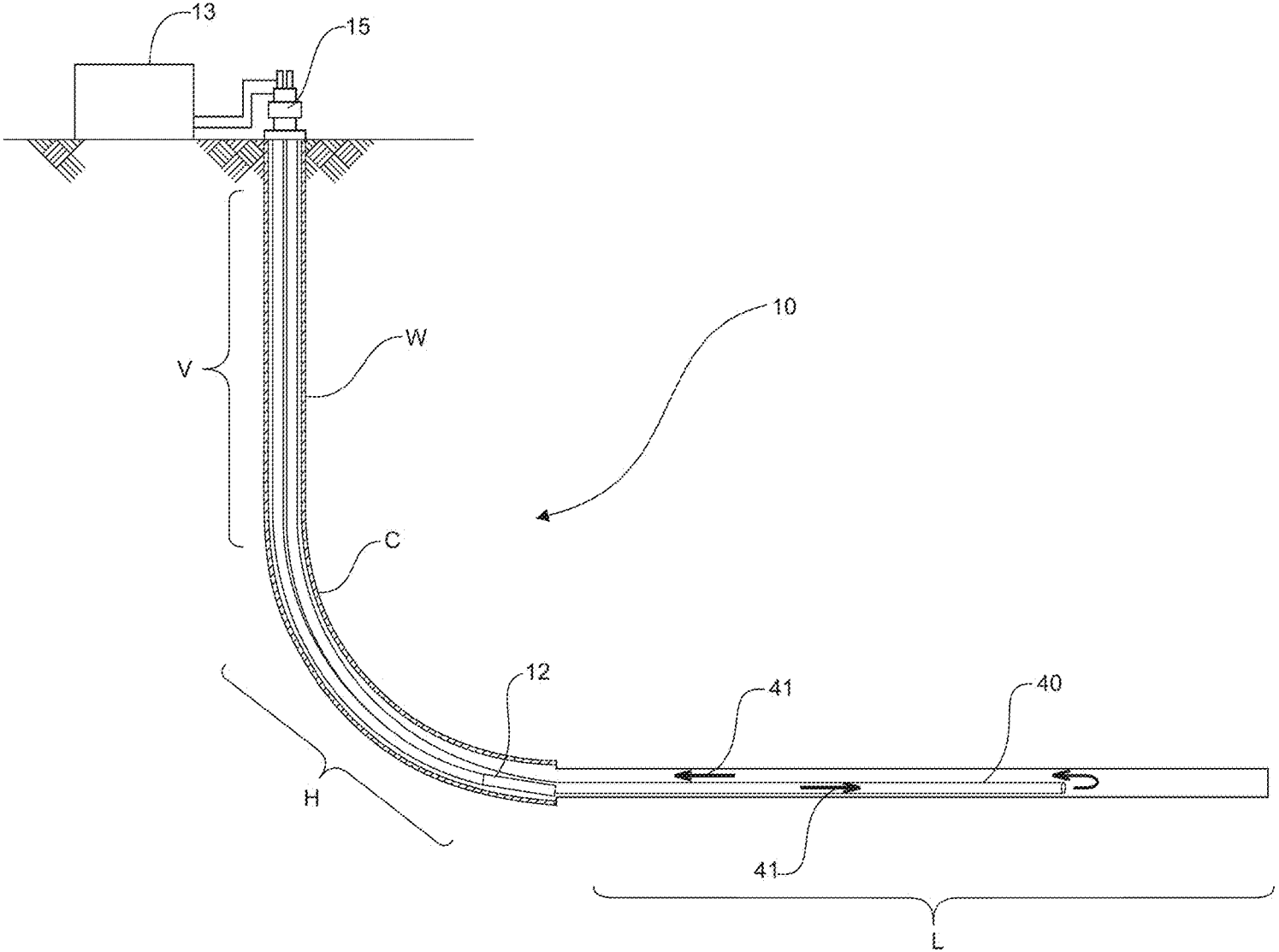
FIG. 7 is a cross-section view of the present well production system wherein the system is in cleanout mode.

According to embodiments herein, it is further contemplated that the present system and method may be used to clean sand and other solid contaminants (wellbore debris)

that can plug up the wellbore W during production. For example, having regard to FIG. 7, where desired (i.e. where solid buildup occurs and fluid transport velocity is insufficient), it is contemplated that at least one pump assembly may be adapted to serve as a flushing string. By way of example, in one embodiment, the downhole pump assembly may be adapted by removing pump 14 and associated inner tubing string 12*i*, leaving the lower outer tubing string 14*o* in the well to act as a flushing tubing string 40. Pressurized flushing fluid 41 flowing through the flushing string 40 serves to sweep contaminants built up in the wellbore towards uphole pump 12. The production rates of pump 12 can be maximized in order to provide sufficient velocity to lift the contaminants. It would be appreciated that the cleanout method may be performed at or below reservoir pressures (e.g. balanced or underbalanced), thereby maintaining bottom hole reservoir pressures and benefitting from existing reservoir flow to assist in withdrawing the contaminants. It is an advantage of the present apparatus and methodologies that the at least one second pump assembly is permanently positioned at or near the toe, yet can readily be configured as either a jet pump or a flushing string.

In operation, the present apparatus and methodologies comprise the use of at least two pump assemblies positioned downhole in a subterranean wellbore for producing fluids from that subterranean wellbore. Each pump assembly may be suspended within the wellbore via a tubular conduit, the conduit operably providing distinct power fluid supply and produced fluid return lines connected to the surface. Each pump assembly may be positioned in the lateral section L of the wellbore. Preferably, at least one pump assembly may be positioned in a first section of the wellbore, while at least one other pump assembly may be positioned in a second section of the wellbore, the second section being downhole from the first section. Each pump assembly may comprise a pump operative to produce fluids from a drainage area surrounding the pump assembly. Each pump assembly may further comprise a data acquisition tool for obtaining bottom hole information from the drainage area surrounding the pump assembly. According to embodiments herein, the performance parameters of each of the at least two pump assemblies may be controlled, allowing the well operator to adjust the pump capacities, minimizing downhole fluid interference and enabling uniform fluid production from both ends of the well (i.e. consistently along the lateral section L of the wellbore). The capacities of each pump assembly may be controlled with or without the use of data obtained from the data acquisition tool. The capacities of each pump assembly may be controlled by increasing or decreasing power fluid flow rates, and/or by changing out internal pump components such as the venturi nozzle or throat.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

We claim:

1. A well production system for recovering hydrocarbons from a subterranean formation, the system comprising:

at least one first pump assembly, for recovering the hydrocarbons from a first section of a wellbore, the first pump assembly operative at a first production rate, the first pump assembly comprising a first fluid supply line and a first fluid return line fluidly sealed from the first fluid supply line; and at least one second pump assembly, for recovering the hydrocarbons from a second section of the wellbore, and the second pump assembly operative at a second production rate, wherein the first and second production rates are independently adjustable and configured to provide a substantially uniform drawdown along the wellbore.

2. The system of claim 1, wherein the second section is downhole from the first section in the wellbore and the second pump assembly is positioned downhole from the first pump assembly.

3. The system of claim 1, wherein the wellbore is a horizontal wellbore having a substantially vertical section and a substantially horizontal or deviated lateral section, connected by an angled heel section, and wherein both the first and second pump assemblies are positioned downhole from the vertical section of the wellbore.

4. The system of claim 3, wherein both the first and second pump assemblies are positioned in the lateral section.

5. The system of claim 3, wherein the second pump assembly is approximately positioned at least farther than a mid-point along the lateral section.

6. The system of claim 1, wherein each of the first and the second pump assemblies are in fluid communication with a power fluid supply system and a wellbore fluid return system.

7. The system of claim 6, wherein the power fluid supply system is in fluid communication with the first fluid supply line for supplying power fluid thereto; and the first fluid return line is in fluid communication with the wellbore fluid return system for transporting produced wellbore fluid thereto.

8. The system of claim 1, wherein each of the first and second pump assemblies comprises a jet pump comprising one or both of a venturi and a diffuser for controlling the pump capacity.

9. The system of claim 8, wherein each of the venturi and the diffuser are substituted to controllably increase or decrease the pump capacity.

10. The system of claim 1, wherein at least one of the first and second pump assemblies further comprise a data-acquisition tool.

11. The system of claim 10, wherein the data-acquisition tool is operative to receive and record bottom hole pressure and temperature from the wellbore at or near the pump assembly.

12. The system of claim 1, wherein the second pump assembly comprises a second fluid supply line and a second fluid return line fluidly sealed from the second fluid supply line.

13. The system of claim 12, wherein the first fluid supply line and the second fluid supply line are one and the same, and wherein the first fluid return line and the second fluid return line are one and the same.

14. The system of claim 1, wherein the first fluid supply line is disposed within the first fluid return line.

15. The system of claim 1, wherein the first fluid supply line is laterally disposed from the first fluid return line.

16. A method of recovering hydrocarbons from a wellbore within a subterranean formation, the method comprising:

providing at least one first pump assembly in the wellbore for recovering the hydrocarbons from a first section of the wellbore, the first pump assembly recovering the hydrocarbons at a first production rate, providing at least one second pump assembly in the wellbore for recovering the hydrocarbons from a second section of the wellbore, the second section being downhole from the first section of the wellbore, the second pump assembly recovering the hydrocarbons at a second production rate, and adjusting one or both of the first and second production rates to provide a substantially uniform drawdown along the well.

17. The method of claim 16, wherein the production rates are adjusted by increasing or decreasing the rate of power fluid driving the pump, by substituting internal pump componentry, or both.

18. The method of claim 16, wherein internal pump componentry controls the fluid flow rates through the pump.

19. The method of claim 18, wherein the internal pump componentry comprise a venturi, a diffuser, or both.

20. The method of claim 16, wherein the method further comprises configuring one of the at least one first or second pump assemblies to flush contaminant buildup in wellbore, and adjusting the production rate of the remaining at least one pump assembly to withdraw the contaminants.

21. The method of claim 20, further comprising maximizing the production rate of the remaining at least one pump assembly.

22. A well production system for recovering hydrocarbons from a subterranean formation, the system comprising:

at least one first jet pump, for recovering the hydrocarbons from a first section of a wellbore, the first jet pump operative at a first production rate; and at least one second jet pump, for recovering the hydrocarbons from a second section of the wellbore, and the second jet pump operative at a second production rate, wherein the first and second production rates are independently adjustable and configured to provide a substantially uniform drawdown along the wellbore.

* * * * *